US009947996B2

(12) United States Patent
Chou et al.

(10) Patent No.: US 9,947,996 B2
(45) Date of Patent: Apr. 17, 2018

(54) ANTENNA DEVICE

(71) Applicant: JIENG TAI INTERNATIONAL ELECTRIC CORP., New Taipei (TW)

(72) Inventors: Yu-Pang Chou, New Taipei (TW); Pei-Zong Rao, New Taipei (TW); Chung-Yen Yang, New Taipei (TW)

(73) Assignee: JIENG TAI INTERNATIONAL ELECTRONIC CORP., New Taipei (TW)

( * ) Notice: Subject to any disclaimer, the term of this patent is extended or adjusted under 35 U.S.C. 154(b) by 158 days.

(21) Appl. No.: 14/578,475

(22) Filed: Dec. 21, 2014

(65) Prior Publication Data

US 2015/0207220 A1 Jul. 23, 2015

(30) Foreign Application Priority Data

Jan. 20, 2014 (TW) ..... 103102001 A

(51) Int. Cl.
*H01Q 21/00* (2006.01)
*H01Q 1/24* (2006.01)

(52) U.S. Cl.
CPC ..... *H01Q 1/245* (2013.01)

(58) Field of Classification Search
CPC ..... H01Q 21/061; H01Q 3/26; H01Q 1/246; H01Q 5/00
USPC ..... 343/893, 852, 725, 853
See application file for complete search history.

(56) References Cited

U.S. PATENT DOCUMENTS

2004/0009754 A1 1/2004 Smith, Jr.
2013/0026820 A1 1/2013 Gocho et al.
2013/0187828 A1* 7/2013 Desclos ..... H03H 7/38 343/861
2015/0022403 A1* 1/2015 Lin ..... H01Q 1/44 343/702

FOREIGN PATENT DOCUMENTS

JP 2013229832 A * 11/2013
TW 201210167 A 3/2012

* cited by examiner

*Primary Examiner* — Dameon E Levi
*Assistant Examiner* — Colin Dawkins
(74) *Attorney, Agent, or Firm* — CKC & Partners Co., Ltd.

(57) ABSTRACT

An antenna device includes an antenna element, a sensing circuit, a matching circuit and an impedance adjusting circuit. The sensing element is used to generate a sensing signal. The matching circuit is coupled to the antenna unit. The impedance adjusting circuit is coupled to the sensing circuit and is capable of turning an impedance of the antenna unit and an impedance of the matching circuit into mismatch according to the sensing signal.

17 Claims, 5 Drawing Sheets

ANTENNA DEVICE

RELATED APPLICATIONS

This application claims priority to Taiwan Application Serial Number 103102001, filed Jan. 20, 2014, which is herein incorporated by reference.

BACKGROUND

Field of Invention

The present invention relates to wireless communication, and more particular to an antenna device that is capable of changing impedance matching between an antenna element and its related circuit.

Description of Related Art

Wireless communication technology is widely used in various kinds of electronic devices for data or voice transmission. In general, the electronic devices may use some specific wireless communication specifications to perform wireless transmission, such as IEEE 802.11, Bluetooth (BT), wide band code division multiple access (WCDMA) and so on.

However, no matter what type of wireless communication is used, a lot of electromagnetic waves are generated during data transmission, thus harming a user's health. Hence, before being put into the market for sale, the electronic devices with wireless communication function have to pass a specific absorption rate (SAR) test, so as to diminish possible dangers to the user due to the electromagnetic waves.

SUMMARY

One aspect of the present invention is to provide an antenna device applicable to an electronic device. While a human body is approaching the antenna device, the electromagnetic radiation power of the antenna device can be lowered to diminish dangers to the human body.

According to one embodiment of the present invention, the antenna device includes an antenna element, a sensing circuit, a matching circuit and an impedance adjusting circuit. The sensing circuit is used to generate a sensing signal. The matching circuit is coupled to the antenna element. The impedance adjusting circuit is coupled to the sensing circuit, in which the impedance adjusting circuit turns an impedance of the antenna element and an impedance of the match circuit to be mismatched according to the sensing signal.

According to one or more embodiments of the present invention, the impedance adjusting circuit is coupled to the antenna element and changes the impedance of the antenna element according to the sensing signal.

According to one or more embodiments of the present invention, the impedance adjusting circuit is coupled to the matching circuit and increases or decreases the impedance of the matching circuit embedded in the antenna element according to the sensing signal.

In summary, in one or more embodiments of the present invention, because the impedance adjusting circuit can change the impedance of the antenna element or change the impedance of the matching circuit, radiation energy from the antenna element can be reduced, thereby enabling the antenna device to meet the desired SAR standard.

BRIEF DESCRIPTION OF THE DRAWINGS

In order to make the invention as well as advantages thereof more apparent, the accompanying drawings are described as follows.

DETAILED DESCRIPTION

Figure 1:
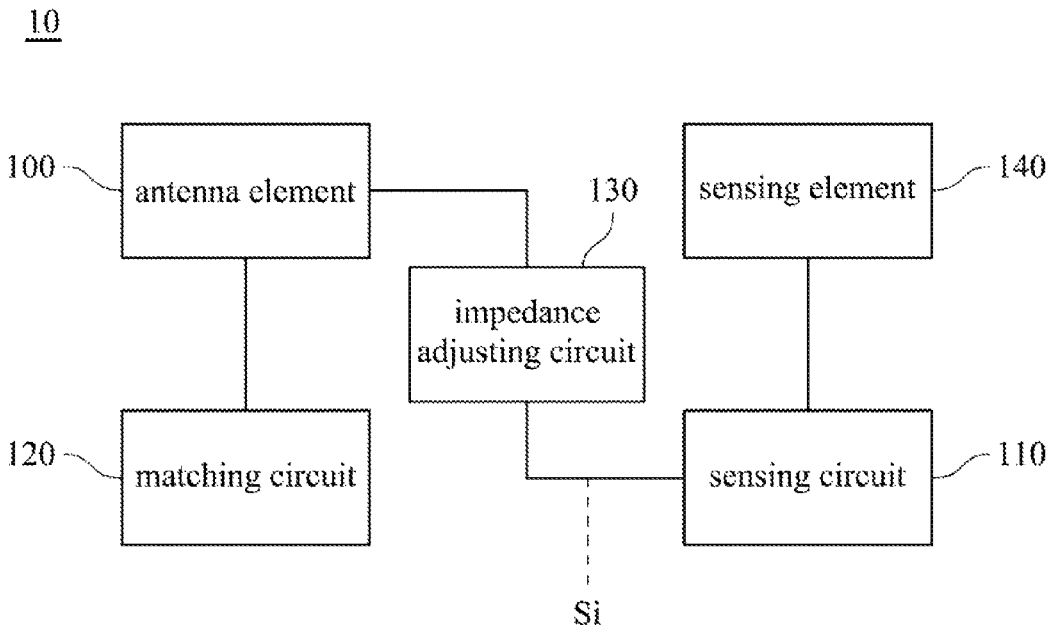
FIG. 1 illustrates a block diagram of an antenna device according to a first embodiment of the present invention.

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for simplifying the drawings, some of the conventional structures and elements are shown with schematic illustrations, and the same reference numerals in different figures denote the same or similar elements.

In this disclosure, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

First, the following embodiments disclose an antenna device, in which the antenna device includes a sensing element used to detect whether a human body approaches. When the human body approaches the antenna device, the antenna device can reduce its electromagnetic radiation power according to a sensing signal generated by the sensing element, so as to diminish dangers of the electromagnetic wave to the human body.

It is worthy to be mentioned that, in the following embodiments, an impedance of an antenna element may be changed or an impedance of a matching circuit that connected to the antenna element may be changed, so that the electromagnetic radiation power of the antenna element may be reduced. In more detail, when the antenna devices of the following embodiments have detected that a human body approaches, the impedance of the antenna element and the impedance of the matching circuit are turned into a "mismatch" state, which results in the increase of return loss of the antenna element and the decrease of radiation gain of the antenna element. Accordingly, an electronic apparatus applying such an antenna device may pass a specific absorption rate (SAR) test regarding the electromagnetic radiation into the human body.

It is noted that, under an ideal condition, the impedance of the antenna element and the impedance of the matching circuit are approximately equal or reach conjugate match. In this case, a voltage standing wave ratio (VSWR) of the antenna element is close to 1, which means almost no return loss. However, in practical applications, the VSWR may have a value of 1~2. As a result, the term "mismatch" between the impedance of the antenna and the impedance of the matching circuit refers to as an increase of the VSWR of the antenna element that results in the increase of return loss of the antenna element and the decrease of radiation power of the antenna element. For example, if an original VSWR value is designed to be 1.25 in an antenna element, when the VSWR value is greater than 1.25, such as 1.5, it can be regarded as the condition of "mismatch". It should be understood that, the above values are merely used as examples for explanation, and are not intended to limit the scope of the invention as claimed. Any devices or methods which change the impedance of the antenna element or the impedance of the matching circuit to cause an impedance mismatch therebetween and thus raise the VSWR value and lower the radiation power of the antenna element should fall within the scope of the invention.

Please refer to FIG. 1, which illustrates a block diagram of an antenna device according to a first embodiment of the present invention. In FIG. 1, the antenna device 10 includes an antenna element 100, a sensing circuit 110, an matching circuit 120 and an impedance adjusting circuit 130, in which the matching circuit 120 is couple to the antenna element 100, the impedance adjusting circuit 130 is coupled to the sensing circuit 110 and the impedance adjusting circuit 130 is directly connected to the antenna element 100.

The sensing circuit 110 is used to generate a sensing signal Si. More specifically, the sensing circuit 110 including a sensing element 140 is capable of detecting whether a human body approaches the antenna device 10. In this embodiment, the sensing element 140 can be a capacitive proximity sensor. While a human body is approaching the antenna device 10, the sensing element 140 is capacitive coupled with the human body to generate coupling capacitance. The sensing circuit 110 may generate the sensing signal Si in response to occurrence of the coupling capacitance.

In practical applications, the sensing element 140 can be implemented by another antenna element, but embodiments of the present invention are not limited thereto. For example, in other embodiments of the present invention, the sensing element 140 is not limited to a capacitive proximity sensor, but can be a thermal sensor or a light sensor.

In the present embodiment, the antenna element 100 may have at least one frequency resonance mode (e.g., GSM850/900/1800/1900). In practical applications, based on practical requirements such as structural limitations or operational frequencies, the antenna element 100 can be implemented by a monopole antenna, a planar inverted antenna (PIFA), an inverted antenna (IFA), a slot antenna or a combination thereof.

Please refer to FIG. 1. In the present embodiment, the matching circuit 120 and the antenna element 100 are impedance matching. For example, if an impedance value of the antenna element 100 is 50 Ohm, then the matching circuit 120 coupled to the antenna element 100 should have an impedance value of about 50 Ohm to minimize the return loss of the antenna element 100. In other embodiments, the impedance value of the antenna element 100 may be 75 Ohm and the matching circuit 120 should also have an impedance value of about 75 Ohm. In practical applications, the impedance value can be different or can be changed according to the system requirements.

The impedance adjusting circuit 130 of the present embodiment can be directly connected to the antenna element 100, and the impedance adjusting circuit 130 can change the impedance value of the antenna element 100 according to the sensing signal Si. For example, the impedance of the antenna element 100 and the impedance of the matching circuit 120 can be turned into mismatch by changing an input impedance of the antenna element 100, so as to reduce the radiation power of the antenna element 100. Accordingly, when a human body approaches the antenna device 10, because the radiation energy of the antenna element 100 is decreased, the SAR is reduced as well.

Further, by using the impedance adjusting circuit 130 to directly change the impedance of the antenna element 100, the electronic apparatus applying the antenna device 10 of the present embodiment do not need a complicated control circuit to adjust the output power of the antenna element 100. Such a complicated control circuit can be a logic circuit, complex programmable logic device (CPLD) and so on, which may be in charge of the program operation in an electronic apparatus. By applying the antenna device 10 provided in this disclosure, the electronic apparatus, such as a tablet computer or smart phone, does not need to provide related software or hardware to change the radiation power of the antenna element 110 for meeting the desired SAR standard.

Figure 2:
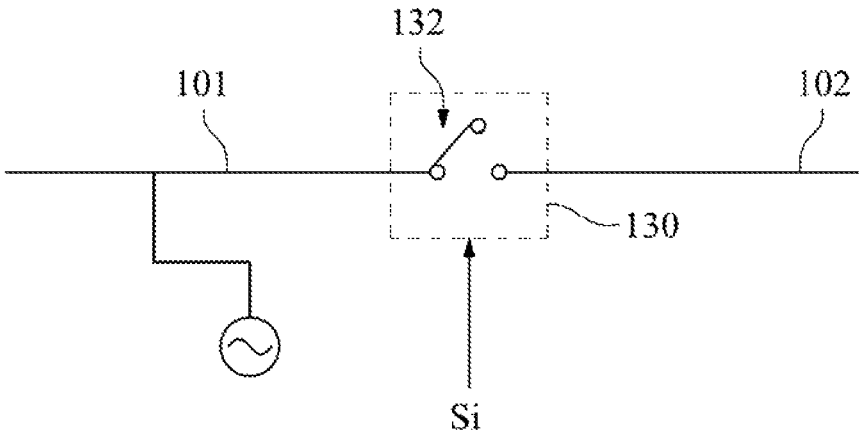
FIG. 2 illustrates an antenna element and an impedance adjusting circuit according to the first embodiment of the present invention.
Figure 3:
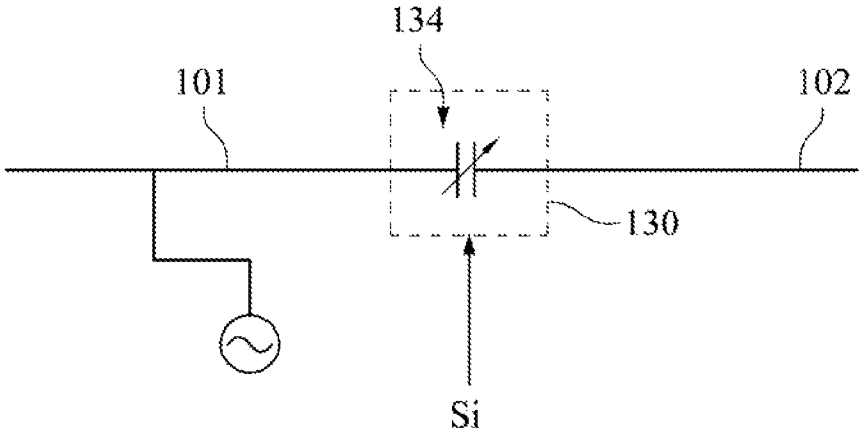
FIG. 3 illustrates an antenna element and an impedance adjusting circuit according to a second embodiment of the present invention.
Figure 4:
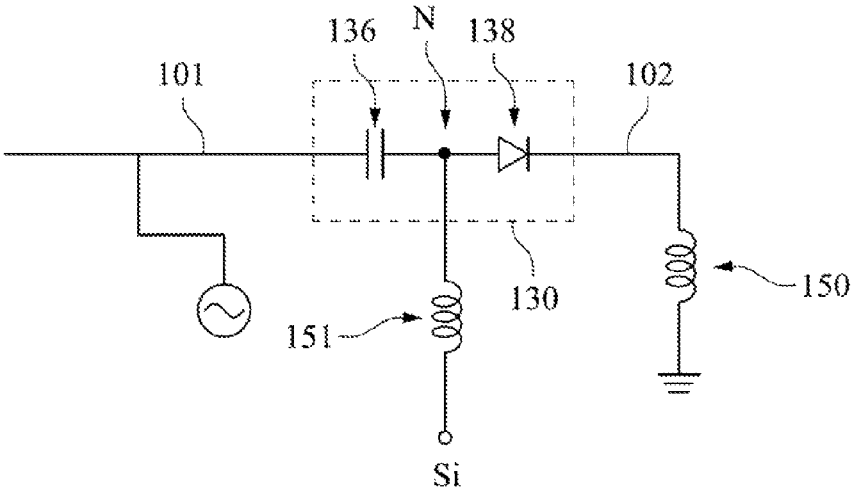
FIG. 4 illustrates an antenna element and an impedance adjusting circuit according to a third embodiment of the present invention.

Then, please refer to FIG. 2 to FIG. 4, in which FIG. 2 illustrates the antenna element and the impedance adjusting circuit according to the first embodiment of the present invention; FIG. 3 illustrates an antenna element and an impedance adjusting circuit according to a second embodiment of the present invention; and FIG. 4 illustrates an antenna element and an impedance adjusting circuit according to a third embodiment of the present invention. It is noted that, the first, second and third embodiments provide three different methods for changing an input impedance of the antenna element 100, such as using a switch 132, a variable capacitance 134 and a diode 138 respectively to change the input impedance of the antenna element 100. More specifically, in some embodiments, the switch 132 is used to change the length of the antenna element 100, but the present invention is not limited thereto. In other embodiments, the switch 132, the variable capacitance 134 and the diode 138 can also be used to change a position of a feeding point or a grounded point, so that the input impedance of the antenna element 100 can be changed as well.

Please refer to FIG. 2, the antenna element 100 further includes a first portion 101 and a second portion 102. The impedance adjusting circuit 130 further includes a switch 132. The switch 132 is disposed between the first portion 101 and the second portion 102. In the present embodiment, the switch 132 can selectively disconnect or connect the first portion 101 from or to the second portion 102 according to the sensing signal Si so that a length of the antenna element 100 is changed.

In more detail, a length of the first portion 101 of the antenna element 100 of the present embodiment can be one half of a wavelength corresponding to an operating frequency. In this case, the first portion 101 can have relatively good radiation efficiency. Therefore, if the length of the antenna element 100 is greater than one half of a wavelength corresponding to an operating frequency, the VSWR of the antenna element 100 is increased, thus resulting in worse radiation efficiency of the antenna element 100. Accordingly, when the impedance adjusting circuit 130 receives the sensing signal Si, the first portion 101 and the second portion 102 are electrically conducted so as to reduce the radiation efficiency of the antenna element 100. In other words, a length of the antenna element 100 is changed from a length of the first portion 101 to a total length of the first portion 101 and the second portion 102, so that the VSWR of the antenna element 100 is increased and the input impedance of the antenna element 100 is changed, thus turning the impedance of the antenna element 100 and the impedance of the matching circuit 120 into a mismatch state.

Thereafter, please refer to FIG. 3. In the second embodiment, the impedance adjusting circuit 130 includes a variable capacitor 134. The variable capacitor 134 is connected between the first portion 101 and the second portion 102. In the present embodiment, a capacitance value the variable capacitor 134 may be changed according to the sensing signal Si, so as to change the input impedance of the antenna element 100.

In more detail, when the impedance adjusting circuit 130 receives the sensing signal Si, a capacitance value of the variable capacitor 134 is increased. In the present embodiment, when the capacitance value of variable capacitor 134 is increased, a capacitive reactance of the variable capacitor 134 can be changed, so that the total input impedance of the first portion 101 connected in series with the variable capacitor 134 and second portion 102 can be changed simultaneously.

Then, please refer to FIG. 4. In the third embodiment, the impedance adjusting circuit 130 includes a capacitor 136 and a diode 138, in which the capacitor 136 and the diode 138 are connected in series and are coupled between the first portion 101 and the second portion 102. The sensing signal Si is inputted to a node N between the capacitor 136 and an anode of the diode 138 through an inductance 151, such that a voltage potential between the capacitor 136 and the diode 138 may be raised to conduct the diode 138. Accordingly, an AC signal from the first portion 101 can be coupled to the second portion 102 through the capacitor 136 so as to achieve the efficacy of changing a length of the antenna element 100.

More specifically, in the present embodiment, an end of the second portion 102 is connected to a high-frequency blocker 150. An end of the high-frequency blocker 150 opposite to the second portion 102 is grounded, so that the high-frequency blocker 150 seems to be an open circuit to an AC signal that is transmitted to the second portion 102. In other embodiments, an end of the second portion 102 can be grounded directly so that the AC signal transmitted into the second portion 102 can be short-circuited immediately. In practical applications, the high-frequency blocker 150 can be implemented by another inductance. As a result, when the sensing signal Si is inputted between the capacitor 136 and the diode 138, a length of the antenna element 100 can be considered as a total length of the first portion 10 and the second portion 102 similar to the first embodiment. Similarly, before the sensing signal Si is inputted between the capacitor 136 and the diode 138, a length of the antenna element 100 can be considered as a length of the first portion 101 similar to the first embodiment. Accordingly, in the present embodiment, the length of the antenna element 100 can be changed between two different values similar to the first embodiment.

It is noted that, the first embodiment to the third embodiment are mainly described about the change of the input impedance of the antenna element 100, so as to make the antenna element 100 and the matching circuit 120 impedance mismatch, but the present invention is not limited thereto. Except for changing the length of the antenna element 100, changing the impedance of the matching circuit 120 embedded in the antenna element 100 can also cause impedance mismatch between the antenna element 100 and the matching circuit 120, and the energy of electromagnetic radiation generated by the antenna element 100 can be reduced as well.

Figure 5:
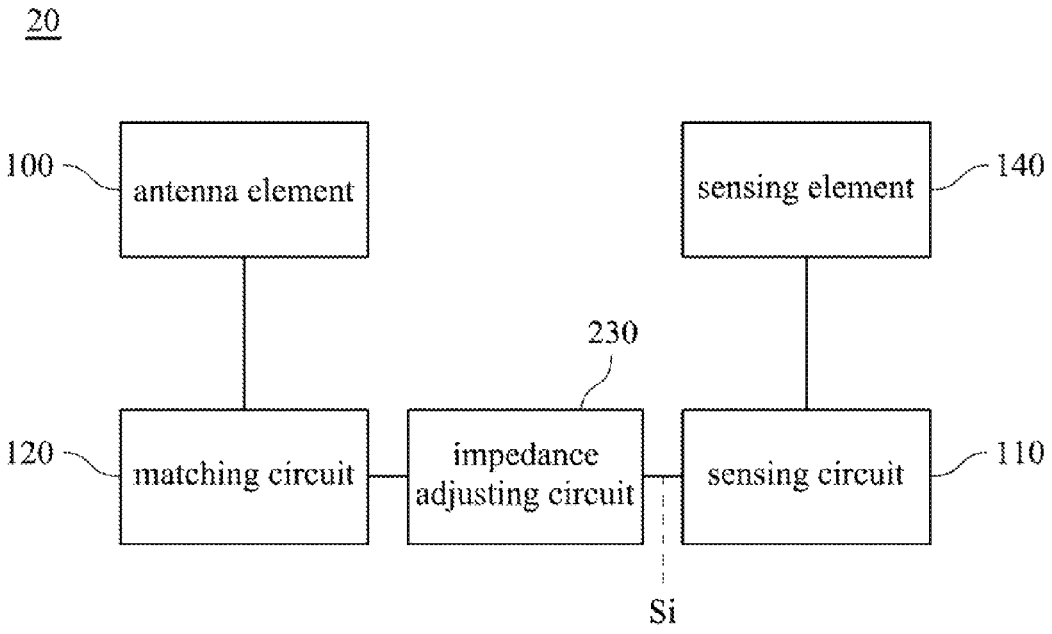
FIG. 5 illustrates a block diagram of an antenna device according to the forth embodiment of the present invention.

Please refer to FIG. 5, which illustrates a block diagram of the antenna device according to the forth embodiment of the present invention. The difference between the present embodiment and the first embodiment is that, the impedance adjusting circuit 230 of the antenna device 20 of the present embodiment is connected to the matching circuit 120 so that the impedance of the matching circuit 120 embedded in the antenna element 100 can be increased or decreased according to the sensing signal Si, which can cause an increase of the return loss of the antenna element 100.

Figure 6:
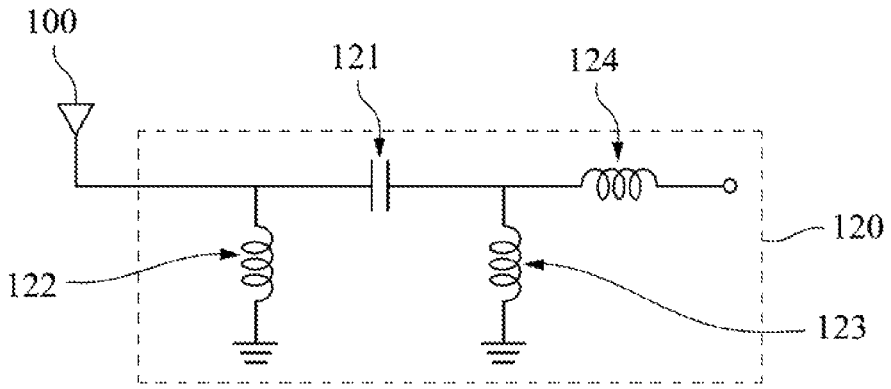
FIG. 6 illustrates a block diagram of a matching circuit according to the forth embodiment of the present invention.

For example, please refer to FIG. 6, which illustrates a block diagram of the match circuit according to the forth embodiment of the present invention. FIG. 6 shows a forth-graded matching circuit 120 with four electrical components, but the present invention is not limited thereto. In other embodiments, as long as the impedance of the antenna element 100 is approximately equal to the impedance of the matching circuit 120, the matching circuit 120 can be designed as a zero-graded, second-graded or third-graded matching circuit 120.

In the present embodiment, the matching circuit 120 can be a π-type matching circuit 120, but the present invention is not limited thereto. In other embodiments of the present invention, the matching circuit 120 can be a L-type, T-type or L-series connecting type. As illustrated in FIG. 6, the arrangement sequence of the capacitor 121 and the inductances 122, 123 and 124 looks like a π-type. In other embodiments, the capacitor 121 in FIG. 6 can be replaced by an inductance, or the inductances 122, 123 and 124 can be replaced by capacitors, so as to obtain a better impedance match.

Figure 7:
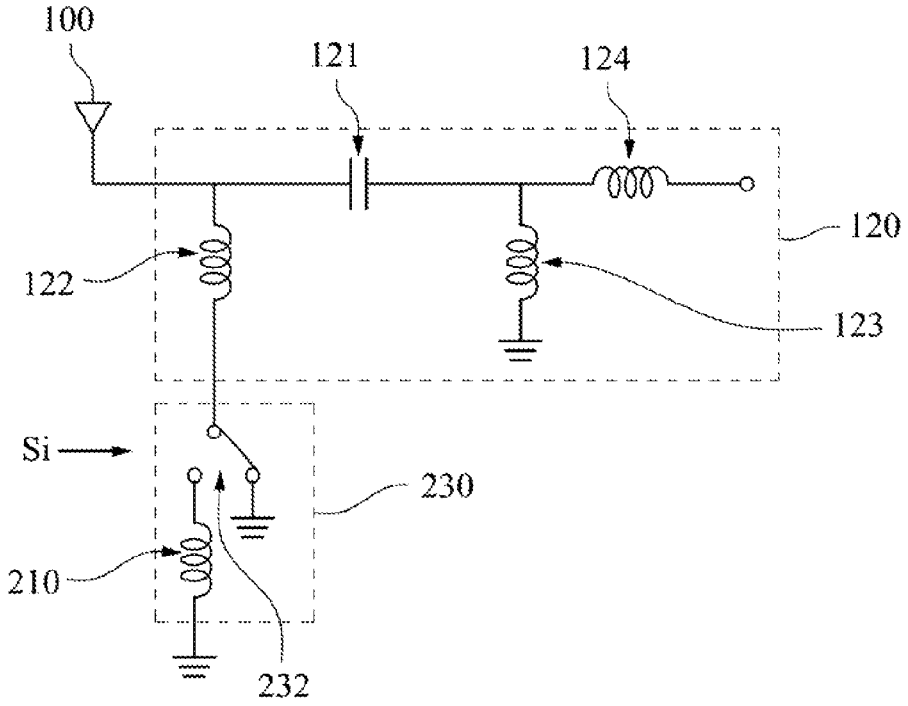
FIG. 7 illustrates a block diagram of a matching circuit and an impedance adjusting circuit according to the forth embodiment of the present invention.
Figure 8:
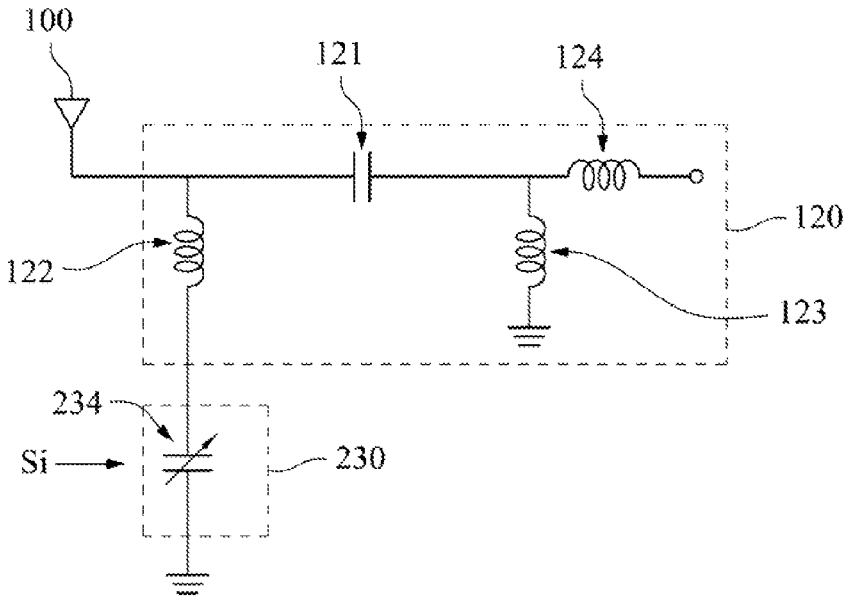
FIG. 8 illustrates a block diagram of a matching circuit and an impedance adjusting circuit according to the fifth embodiment of the present invention.
Figure 9:
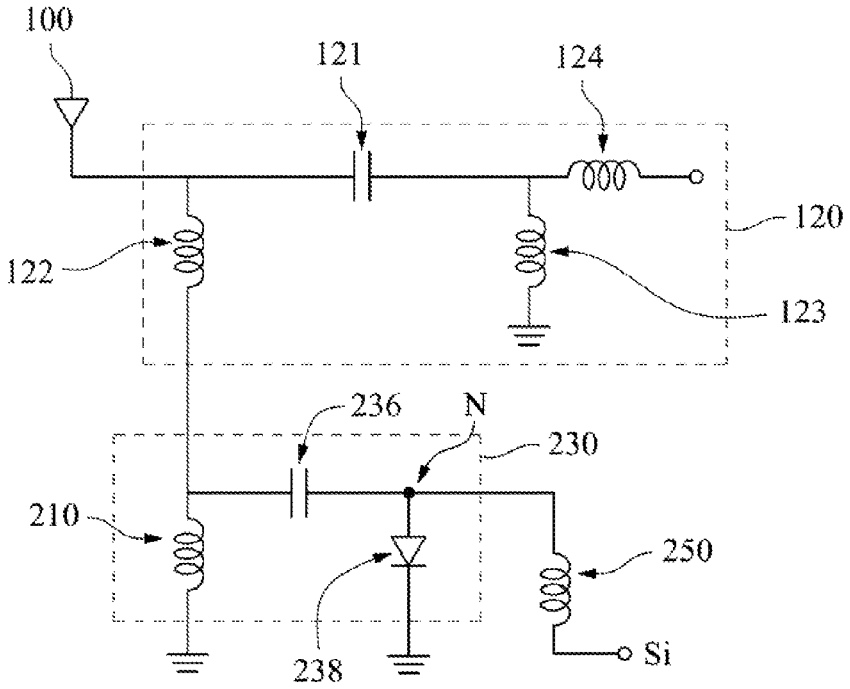
FIG. 9 illustrates a block diagram of a matching circuit and an impedance adjusting circuit according to the sixth embodiment of the present invention.

Thereafter, please refer to FIG. 7 to FIG. 9, in which FIG. 7 illustrates a block diagram of the matching circuit and the impedance adjusting circuit according to the forth embodiment of the present invention; FIG. 8 illustrates a block diagram of the matching circuit and the impedance adjusting circuit according to the fifth embodiment of the present invention; and FIG. 9 illustrates a block diagram of the matching circuit and the impedance adjusting circuit according to the sixth embodiment of the present invention. It is noted that, in the fourth, fifth, and sixth embodiments, the impedance adjusting circuit 230 is connected to the inductance 122 nearest to the antenna element 100, but the present invention is not limited thereto. In other embodiments, the impedance adjusting circuit 230 can be connected to other electrical components such as a capacitor 121, an inductance 123 or 124.

Please refer to FIG. 7, the impedance adjusting circuit 230 includes a switch 232 and an impedor 210, in which the switch 230 may selectively connect or disconnect the matching circuit 120 to or from the impedor 210 according to the sensing signal Si. In the present embodiment, the impedor 210 can be implemented by an inductance, but the present invention is not limited thereto. In other embodiments, the impedor 210 can be implemented by a capacitor or other electrical components capable of blocking the high-frequency AC signal. When the matching circuit 120 is connected with the impedor 210, the impedor 210 blocks the AC signal, thus resulting in the change of an impedance of the matching circuit 120 embedded in the antenna element 100, so as to reduce the radiation energy of the antenna element 100.

Then, please refer to FIG. 8. The impedance adjusting circuit 230 may include a variable capacitor 234. An end of the variable capacitor 234 is coupled to the matching circuit 120, and the other end of the variable capacitor 234 is grounded. The impedance adjusting circuit 230 can change a capacitance value of the variable capacitor 234 according to the sensing signal Si, so that the impedance value embedded in the antenna element 100 can be changed simultaneously in accordance with the capacitance value of the variable capacitor 234, and thus, the return loss of the antenna element 100 can increased and the energy radiated by the antenna element 100 can be lowered.

Thereafter, refer to FIG. 9. The impedance adjusting circuit 230 may include a capacitor 236 and a diode 238, in which the capacitor 236 is connected in series to the diode 238, and the sensing signal Si is inputted into a node N between the capacitor 236 and an anode of the diode 238. In the present embodiment, the sensing signal Si can be transmitted to the node N through a high-frequency blocker 250, so as to raise a voltage potential between the capacitor 236 and the diode 238 and to change the impedance value of the matching circuit 120 embedded in the antenna element 100 for reducing the radiation energy of the antenna element 100.

As discussed by the embodiments disclosed above, the antenna device can generate a sensing signal while a human body approaches the antenna device, and an impedance adjusting circuit can change an impedance of an antenna element or change an impedance of a matching circuit according to the sensing signal, so that the impedance of the antenna element and the impedance of the matching circuit can be turned into a mismatch state. Accordingly, the return loss of the antenna element is increased and radiation energy of the antenna element is reduced, so as to meet the desired SAR standard. Furthermore, by applying the antenna device of the embodiments, the electronic apparatus does not need to use a complicated control circuit to control an output power of the antenna element such that the radiation power of the antenna device can be reduced without needing to increase the loading of the electronic apparatus.

Although the present invention has been described in considerable detail with reference to certain embodiments thereof, other embodiments are possible. Therefore, the spirit and scope of the appended claims should not be limited to the description of the embodiments contained herein.

What is claimed is:

1. An antenna device, comprising:

an antenna element;

a sensing circuit for generating a sensing signal in response to a human body approaching the antenna device;

a matching circuit coupled to the antenna element, wherein the matching circuit and the antenna element are impedance matching; and an impedance adjusting circuit coupled to the sensing circuit to receive the sensing signal, wherein the impedance adjusting circuit comprises a switch which operates according to the sensing signal, and wherein when the switch is operated according to the sensing signal, the impedance adjusting circuit couples to the matching circuit or the antenna element to turn an impedance of the antenna element and an impedance of the matching circuit into a mismatch state to decrease a radiation gain of the antenna element when the impedance adjusting circuit receives the sensing signal.

2. The antenna device of claim 1, wherein the impedance adjusting circuit is coupled to the antenna element and changes the impedance of the antenna element according to the sensing signal.

3. The antenna device of claim 2, wherein the antenna element includes a first portion and a second portion, and the switch is disposed between the first portion and the second portion and selectively disconnects or connects the first portion from or to the second portion according to the sensing signal.

4. The antenna device of claim 1, wherein the impedance adjusting circuit is coupled to the matching circuit and increases or decreases the impedance of the matching circuit embedded in the antenna element according to the sensing signal.

5. The antenna device of claim 4, wherein the impedance adjusting circuit further comprises an impedor, in which the switch selectively connects or disconnects the matching circuit to or from the impedor according to the sensing signal.

6. The antenna device of claim 1, wherein the sensing circuit comprises a sensing element for detecting whether a human body approaches the antenna device.

7. An antenna device, comprising:

an antenna element;

a sensing circuit for generating a sensing signal in response to a human body approaching the antenna device;

a matching circuit coupled to the antenna element, wherein the matching circuit and the antenna element are impedance matching; and an impedance adjusting circuit coupled to the sensing circuit, wherein the impedance adjusting circuit comprises a variable capacitor, and a capacitance value of the variable capacitor is changed according to the sensing signal, and wherein when the capacitance value of the variable capacitor is changed according to the sensing signal, the changed capacitance value is coupled to the matching circuit or the antenna element to turn an impedance of the antenna element and an impedance of the matching circuit into a mismatch state to decrease a radiation gain of the antenna element when the impedance adjusting circuit receives the sensing signal.

8. The antenna device of claim 7, wherein the impedance adjusting circuit is coupled to the antenna element and changes the impedance of the antenna element according to the sensing signal.

9. The antenna device of claim 8, wherein the antenna element comprises a first portion and a second portion, and the variable capacitor connected between the first portion and the second portion.

10. The antenna device of claim 7, wherein the impedance adjusting circuit is coupled to the matching circuit and increases or decreases the impedance of the matching circuit embedded in the antenna element according to the sensing signal.

11. The antenna device of claim 10, wherein the variable capacitor is coupled to the matching circuit.

12. The antenna device of claim 7, wherein the sensing circuit comprises a sensing element for detecting whether a human body approaches the antenna device.

13. An antenna device, comprising:

an antenna element;

a sensing circuit for generating a sensing signal in response to a human body approaching the antenna device;

a matching circuit coupled to the antenna element, wherein the matching circuit and the antenna element are impedance matching; and an impedance adjusting circuit coupled to the sensing circuit, wherein the impedance adjusting circuit comprises a capacitor and a diode, the capacitor is connected in series with the diode, and the sensing signal is inputted to a node between the capacitor and an anode of the diode, and wherein when the sensing signal conducts the diode, an AC signal is coupled to the matching circuit or the antenna element to turn an impedance of the antenna element and an impedance of the matching circuit into a mismatch state to decrease a radiation gain of the antenna element when the impedance adjusting circuit receives the sensing signal.

14. The antenna device of claim 13, wherein the impedance adjusting circuit is coupled to the antenna element and changes the impedance of the antenna element according to the sensing signal.

15. The antenna device of claim 14, wherein the antenna element comprises a first portion and a second portion, and the capacitor and the diode are connected between the first portion and the second portion.

16. The antenna device of claim 13, wherein the impedance adjusting circuit is coupled to the matching circuit and increases or decreases the impedance of the matching circuit embedded in the antenna element according to the sensing signal.

17. The antenna device of claim 13, wherein the sensing circuit comprises a sensing element for detecting whether a human body approaches the antenna device.

* * * * *